310-335 SR
5/18/84 XR 4,472,204

United States Patent [19]

Fischbach

[11] Patent Number: 4,472,204

[45] Date of Patent: Sep. 18, 1984

[54] PROCESS AND APPARATUS FOR CLEANING AND WETTING THE CONCAVE SURFACE OF AN ACOUSTIC LENS

[75] Inventor: Herbert Fischbach, Wetzlar, Fed. Rep. of Germany

[73] Assignee: Ernst Leitz Wetzlar GmbH, Wetzlar, Fed. Rep. of Germany

[21] Appl. No.: 384,893

[22] Filed: Jun. 4, 1982

[30] Foreign Application Priority Data

Jun. 5, 1981 [DE] Fed. Rep. of Germany ..... 3122408

[51] Int. Cl.[3] ..... B08B 3/02

[52] U.S. Cl. ..... 134/10; 134/18; 134/32; 134/34; 310/335

[58] Field of Search ..... 134/1, 16, 32, 34, 184, 134/18, 10; 310/335

[56] References Cited

U.S. PATENT DOCUMENTS

| | | | |
|---|---|---|---|
| 3,212,378 | 10/1965 | Rice | 134/17 |
| 3,360,400 | 12/1967 | Evans et al. | 134/34 |
| 3,928,063 | 12/1975 | King et al. | 134/1 |
| 4,187,868 | 2/1980 | Rudolphi | 134/1 X |

*Primary Examiner*—Marc L. Caroff

*Attorney, Agent, or Firm*—Schwartz, Jeffery, Schwaab, Mack, Blumenthal & Koch

[57] ABSTRACT

A spherically concave frontal surface of an acoustic lens in an acoustic microscope is cleaned and wetted by directing a stream of a cleaning and wetting liquid, slightly larger in diameter than the concave surface, against the concave frontal surface of the lens.

17 Claims, 3 Drawing Figures

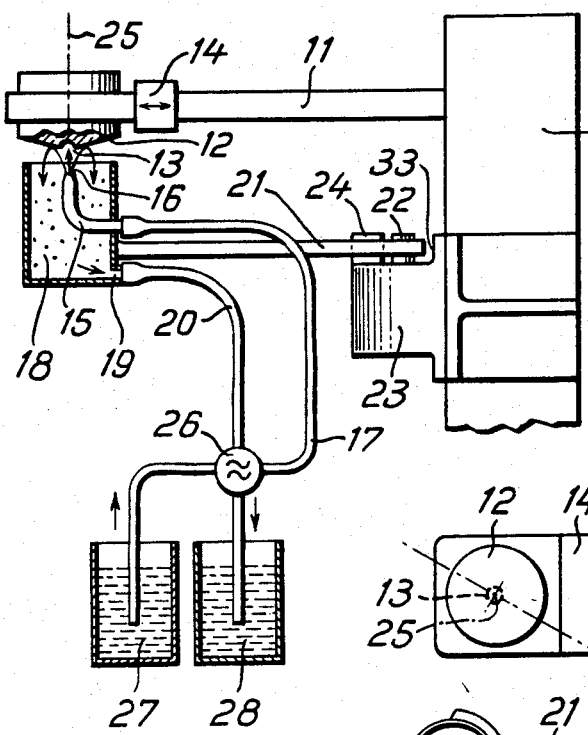
Fig. 1
Fig. 2
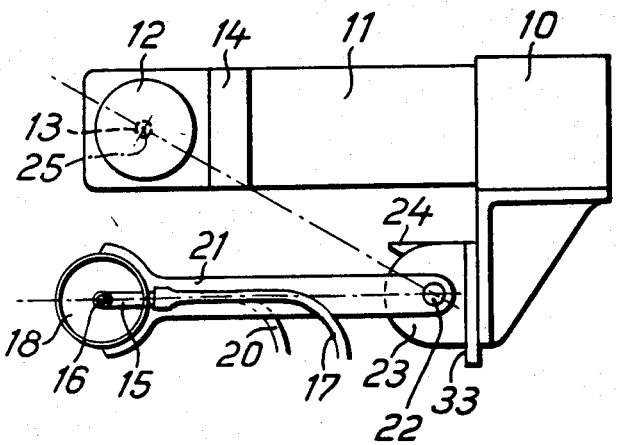
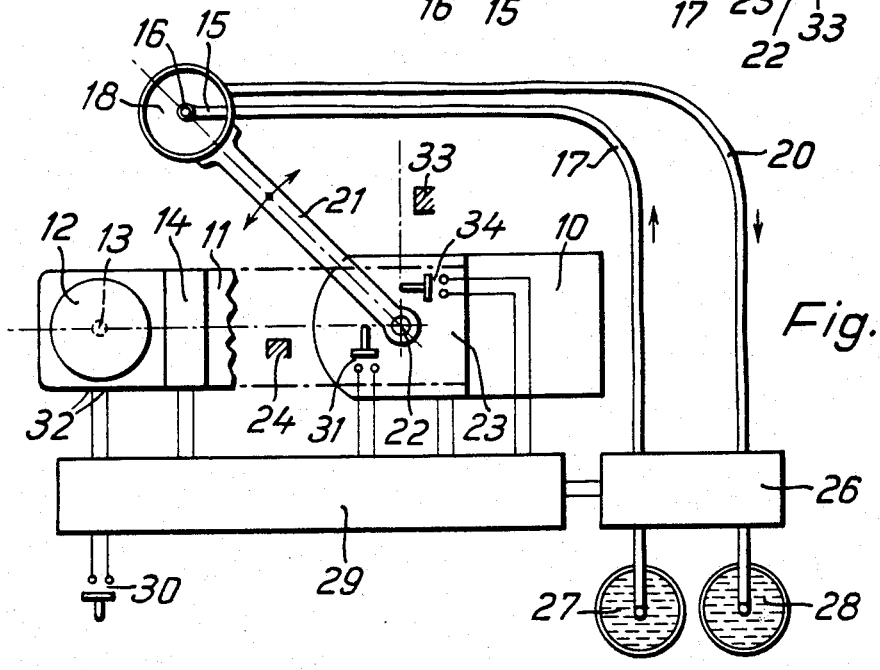
Fig. 3

PROCESS AND APPARATUS FOR CLEANING AND WETTING THE CONCAVE SURFACE OF AN ACOUSTIC LENS

The invention relates to a process and an apparatus for cleaning and wetting the front surface of an ultrasonic objective.

An acoustic microscope is known from DE-OS No. 25 04 988. The essential part of this microscope is an acoustic lens for focusing the sound waves. A piezoelectric transducer mounted on the acoustic lens and coupled with a high frequency generator or receiver serves to produce and detect the sound waves. The structural element comprising the acoustic lens and the piezoelectric transducer shall be referred to as the ultrasonic objective.

The piezoelectric transducer produces a flat sound wave in the acoustic lens. By means of a special configuration of the front surface of the acoustic lens, the emitted sound wave is focussed upon passage into a medium with a lower sound velocity coefficient. The front surface is customarily spherically concave, with the surface polished and treated to minimize reflection. The radius of curvature of this front surface amounts to approximately 100 $\mu$m and the diameter about 80 $\mu$m.

For the passage of the sound wave into the medium with the lower sound velocity coefficient (immersion) it is important that an undisturbed, intimate contact exist between the front surface of the lens and the immersion. For this purpose, in particular, all deposits on the front surface, which increase the surface tension of the lens, must be removed, since otherwise the front surface is only incompletely wetted by the immersion, and a bubble of air will be enclosed in the spherical section defined by the front surface.

Cleaning and wetting of the front surface of the ultrasonic objective must be carried out prior to the beginning of each use and change of specimens. The conventional method consists of rubbing the front surface with a cotton swab moistened with distilled water, until a video signal is produced at the signal outlet of the microscope resulting from the movement of the cotton tip. Subsequently, a drop of the immersion, for example also distilled water, is thereafter deposited on the front surface with a pipette.

This mode of cleaning and wetting is laborious and very time consuming. For the first cleaning prior to work, periods of time between 30 and 45 minutes are often required. This is explained by the fact that the head of the cotton swab is very much larger than the front surface of the ultrasonic objective to be cleaned, and whether individual fibers enter the spherical section and wipe across the front surface, depends mostly on chance. In addition to the time required, there is also the danger that the treated layer will be damaged. Automation of the procedure with reproducible results is not possible.

It is therefore the object of the invention to provide a process and a suitable apparatus, with which a rapid and safe cleaning and wetting of the front surface of the ultrasonic objective is possible, and with which the sequence of steps and the operation of the apparatus may be automated.

This object is achieved according to the invention in that a fine jet of a cleaning and or wetting liquid is directed against the front surface of the lens.

It is advantageous if a pulsating jet is used. Also, the ultrasonic objective may oscillate transversely to the liquid jet during the cleaning process. Distilled water is suitably used as the cleaning and wetting liquid. In the case of an ultrasonic objective operating in reflection, the electric signal produced at the signal outlet during the cleaning process may be measured and the end of the cleaning operation may be determined as a function of the magnitude of the signal.

An apparatus according to the invention for carrying out this process is distinguished by a nozzle directed against the front surface of the lens being provided, which is connected through a line with a supply vessel for the cleaning and/or wetting liquid and by a pump being inserted in the line, which forces the liquid under pressure through the nozzle outlet. The nozzle may be directed upwardly, arranged under the front surface of the lens and surrounded by a collecting vessel for the liquid. Advantageously, an aspirator line is connected to the collecting vessel. It is advantageous if a pump is provided, which is connectable to the nozzle line and to the aspirator line, providing an overpressure in the former and a negative pressure in the latter. The pump may also produce pulsating overpressure and negative pressure. In place of the collecting vessel, the nozzle outlet may also be concentrically surrounded by an aspirator channel, in which suction is produced during the cleaning process. The part of the apparatus containing the nozzle may be mounted on a pivoting device, which is advantageously associated with a stop in such a way that the nozzle outlet lies opposite the front surface of the lens to be cleaned or wetted when placed on said stop. For the purpose of further automation, the pivoting device may be provided with a motorized drive. The diameter of the nozzle outlet may be selected to be somewhat larger than the diameter of the lens front surface to be cleaned. A program control unit makes possible an automatic cleaning and/or wetting procedure.

Exemplary embodiments of the apparatus of the invention will be described with reference to the drawings. These show schematically in FIG. 1 a cross-sectional view of the cleaning apparatus in the working position, FIG. 2 a plan view, FIG. 3 a bock circuit diagram for a fully automatic cleaning apparatus.

In FIG. 1 a supporting arm 11 is mounted on a stand 10 and carries the ultrasonic objective 12 having a spherically concave configured front surface 13. An oscillating device 14 is built into the supporting arm 11, whereby the ultrasonic objective 12 may be placed in oscillating motion in the direction of the arrow.

The cleaning and wetting apparatus comprises a nozzle 15, the outlet 16 of which is directed toward the front surface 13 of the ultrasonic objective. The cleaning and wetting liquid is conducted through a tube 17 into the nozzle 15. As can be seen from FIG. 1, the stream of liquid from nozzle 15 is directed substantially perpendicularly against the front surface 13 of the ultrasonic objective. The nozzle 15 is surrounded by a collecting vessel 18 provided with a drain opening to which a hose 20 is connected. Nozzle 15 and collecting vessel 18 are rigidly connected to each other and are arranged on a pivoting arm 21, which may be pivoted around an axis or shaft 22. The latter may be, for example, the shaft of a motor 23, which also is mounted on the stand 10.

The plan view in FIG. 2 shows the cleaning and wetting apparatus pivoted away from the adjacent acoustic microscope installation, which may also comprise an object table or microscope stage, mounted on the stand 10, which is not shown further because, for example, it would be covered up by the supporting arm 11. A stop 24 is provided for the pivoting arm 21. When the pivoting arm 21 lies against the stop 24, the nozzle outlet 16 is pivoted into the axis 25 of the acoustic microscope.

The tubes 17 and 20 are connected to a pump 26, which forces liquid from a supply vessel 27 into the nozzle 15 and conducts the liquid found in the collecting vessel 18 into a vessel 28. The mode of operation of pump 26 is designed in such a way, for example, that periodically an overpressure is produced in the nozzle line 17 and a negative pressure is produced in the aspirator line 20. In this manner, a pulsating jet of the cleaning liquid is emitted from the nozzle outlet 16.

The circuit diagram according to FIG. 3 shows a fully automatic apparatus, the operational sequence of which is controlled, for example, by a microprocessor 29. By means of a start key 30, the motor 23 of the pivoting device 21/22 is placed in motion toward the surface of stop 24 and upon contact is turned off by the switch 31. Subsequently, the pump 26 and the oscillator 14 are turned on. A jet of the liquid is forced through the nozzle 16 against the surface of the lens of the ultrasonic objective 12. The liquid dripping from the surface of the objective is collected in the collecting vessel 18 and aspirated away by the pump. The piezoelectrically transduced ultrasonic signal at the outlet 32 of the objective 12 is introduced into the microprocessor 29 which after a signal of suitable magnitude is present, first turns off the pump 26 and the oscillator 14, and thereafter turns on the motor 23, which pivots the pivoting arm 21 toward the surface of stop 33. Upon contact with this surface, a switch 34 turns the cleaning apparatus off.

Since the nozzle outlet 16, as shown in FIG. 1, has a very small spacing from the front surface 13 to be cleaned, a drop of the liquid used remains adhering to this surface after the cleaning apparatus is pivoted away so that the objective is automatically wetted. Since distilled water is predominantly used for cleaning and as the immersion, cleaning and wetting are thus effected in a single operating step.

The diameter of the jet emitted from the nozzle 16, as also can be seen in FIG. 1, is somewhat larger than the diameter of the spherically concave configured surface 13 so that certain tolerances in the pivoting of the apparatus are acceptable and it is additionally made certain that the surface 13 to be cleaned is always sprayed during the oscillation of the ultrasonic objective. The movement of the objective transversely to the direction of the liquid jet is advantageous, but is not an essential condition of the mode of operation of the apparatus. It has been found surprisingly that a low jet pressure and the turbulence present in the jet or produced by the differential reflection when the jet impinges on the surface of the lens alone will effect cleaning and force air bubbles out of the spherical segment. Additionally, it has been found that after an initial thorough cleaning, the cleaning times required, even after an interruption in operation of several days, are clearly shorter than in the initial cleaning.

The embodiment illustrated in the drawings uses, for example, an ultrasonic objective operating in reflection, which is disposed above the object. The cleaning apparatus is, therefore, pivoted under the objective and the cleaning liquid dripping from the objective can simply be collected in a vessel. However, an inverted mode of operation is also possible. In order to than prevent the cleaning liquid from running into the casing of the ultrasonic objective, an aspirator channel may be arranged around the nozzle outlet 16 in which sufficient suction is produced by the pump 26 to aspirate the cleaning liquid from the objective. By a suitable timing of the jet and aspiration, it may be assured that at the end of the cleaning operation, a drop of the liquid still wets the front surface 13.

When ultrasonic objectives are used in which electrical measurement of the ultrasonic contact between the front surface 13 and the transfer medium is not possible, a time period determined as a result of experience may be specified for the cleaning process. This period may, for example, be set on the microprocessor 29. In any case, it will clearly be less than the times previously required for mechanical wiping of the lens surface.

We claim:

1. A process for cleaning and wetting a spherically concave frontal surface of an acoustic lens of an ultrasonic objective of an acoustic microscope liquid slightly larger in diameter than the diameter of the spherically concave frontal surface of the acoustic lens at low jet pressure substantially perpendicularly against the frontal surface of the acoustic lens.

2. Process according to claim 1, characterized in that a pulsating jet of the liquid is directed against the front surface (13) of the lens.

3. Process according to claim 1 characterized in that the ultrasonic objective (12) oscillates transversely to the jet of liquid during the cleaning process.

4. Process according to claim 1 characterized in that the cleaning and wetting are effected with distilled water.

5. Process according to claim 1 characterized in that the ultrasonic objective (12) is operated in a reflection mode during the cleaning process and an electrical signal thereby generated at a signal outlet is measured to determine the progress of the cleaning operation as a function of the magnitude of the signal.

6. In an acoustic microscope, the combination comprising:

an ultrasonic objective including an acoustic lens hving a spherically concave frontal surface;

a nozzle operatively connected to a source of cleaning and wetting liquid and having an outlet;

means for positioning said nozzle closely adjacent said ultrasonic objective with said outlet directed toward the frontal surface of said acoustic lens;

means for conveying cleaning and wetting liquid from said source and through said nozzle to direct a fine stream of said cleaning and wetting liquid slightly larger in diameter than the diameter of said concave frontal surface against said concave frontal surface of said acoustic lens; and means for collecting liquid from said ultrasonic objective.

7. Apparatus according to claim 6, characterized in that the nozzle (15/16) is directed upwardly, is arranged underneath the front surface (13) of the lens and is surrounded by a collecting vessel (18) for the liquid.

8. Apparatus according to claim 7, characterized in that an aspirator line (20) is connected to the collecting vessel (18).

9. Apparatus according to claim 7, characterized in that a pump (26) is provided, which is connected with the nozzle and with the aspirator line (20) and which produces an overpressure in the former and a negative pressure in the latter.

10. Apparatus according to claim 9, characterized in that the pump (26) produces a pulsating overpressure and negative pressure.

11. Apparatus according to claim 6, characterized in that the nozzle outlet (16) is surrounded concentrically by an aspirator channel, in which a suction flow is produced during the cleaning process.

12. Apparatus according to claim 6, characterized in that the nozzle (15/16) is mounted on a pivoting device (21,22).

13. Apparatus according to claim 12, characterized in that the pivoting device (21, 22) is associated with a stop (24) in such a way that the nozzle outlet (16) lies opposite the front surface (13) of the lens to be cleaned or wetted when the pivoting device lies against the stop.

14. Apparatus according to claim 12, characterized in that the pivoting device (21, 22) is provided with a motorized drive (23).

15. Apparatus according to claim 6, characterized in that the diameter of the nozzle outlet (16) is selected to be somewhat larger than the diameter of the front surface (13) of the lens to be cleaned.

16. Apparatus according to claim 6, characterized in that a program control unit (29) for an automatic cleaning and/or wetting procedure is provided.

17. A process for cleaning and wetting a spherically concave frontal surface of an acoustic lens of an ultrasonic objective of an acoustic microscope, said process comprising the steps of:

providing a nozzle positioned closely adjacent said ultrasonic objective and having an outlet directed toward said concave frontal surface, said nozzle being operatively connected to a source of cleaning and wetting liquid;

forcing cleaning and wetting liquid from said source through said nozzle to direct a fine stream of said cleaning and wetting liquid slightly larger in diameter than the diameter of said concave frontal surface against the frontal surface of said acoustic lens until any surface deposits which could disturb the operation of the acoustic microscope have been removed;

simultaneously with the preceding step collecting the liquid from the ultrasonic objective;

thereafter discontinuing the flow of cleaning and wetting liquid against said acoustic lens; and retaining at least a drop of said cleaning and wetting liquid on said concave frontal surface of said acoustic lens to wet the front surface of the lens.

* * * * *